US007621615B2

(12) United States Patent
Kikuchi et al.

(10) Patent No.: US 7,621,615 B2
(45) Date of Patent: Nov. 24, 2009

(54) PRINT MEDIUM IDENTIFYING DEVICE, PRINTING APPARATUS, AND PRINT MEDIUM IDENTIFYING METHOD

(75) Inventors: Shoji Kikuchi, Yokohama (JP); Akira Miyakawa, Tokyo (JP); Mitsuyuki Fujibayashi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 440 days.

(21) Appl. No.: 11/091,431

(22) Filed: Mar. 29, 2005

(65) Prior Publication Data

US 2005/0219305 A1 Oct. 6, 2005

(30) Foreign Application Priority Data

Mar. 31, 2004 (JP) ..... 2004-107753
Mar. 2, 2005 (JP) ..... 2005-058088

(51) Int. Cl.
*B41J 29/393* (2006.01)
*B41J 2/01* (2006.01)
*B41J 3/407* (2006.01)

(52) U.S. Cl. ..... 347/19; 347/105; 347/106

(58) Field of Classification Search ..... 347/19, 347/105, 106

See application file for complete search history.

(56) References Cited

U.S. PATENT DOCUMENTS 5,793,399 A 8/1998 Kawakami et al. ..... 347/104
5,886,729 A 3/1999 Hiramatsu et al. ..... 347/264
6,483,585 B1 * 11/2002 Yang ..... 356/369
6,585,341 B1 * 7/2003 Walker et al. ..... 347/14
2005/0047299 A1 3/2005 Kikuchi et al. ..... 369/53.2

FOREIGN PATENT DOCUMENTS

JP 6-15861 1/1994
WO WO 03/086771 A2 10/2003

OTHER PUBLICATIONS

Official Action issued by the Japanese Patent Office, dated Sep. 10, 2008, in Japanese Patent Application No. 2005-058088.

* cited by examiner

*Primary Examiner*—Matthew Luu
*Assistant Examiner*—Jannelle M Lebron
(74) *Attorney, Agent, or Firm*—Fitzpatrick, Cella, Harper & Scinto

(57) ABSTRACT

An object of the present invention is to provide a print medium identifying device that can accurately detect various print media. Thus, according to the present invention, a light emitting section (LED) irradiates a surface of a print medium P with ultraviolet light and different light of a longer wave. A light receiving section (regular-reflection photo sensor and diffusive-reflection photo sensor) receives the light reflected by the surface of the print medium P to output a signal corresponding to the quantity of light received. Identifying section (signal processing section) identifies the type of the print medium on the basis of a signal output by the light receiving section when the print medium is irradiated with the ultraviolet light and a signal output by the light receiving section when the print medium is irradiated with the different light.

9 Claims, 14 Drawing Sheets

PRINT MEDIUM IDENTIFYING DEVICE, PRINTING APPARATUS, AND PRINT MEDIUM IDENTIFYING METHOD

BACKGROUND OF THE INVENTION

1. Field of the Invention

The present invention relates to a print medium identifying device and method for identifying the type of print media used for a printing apparatus, as well as a printing apparatus comprising the print medium identifying device.

2. Description of the Related Art

Printing apparatuses use electrophotographic systems, wire dot systems, ink jet printing systems, and many other systems as output apparatuses for image forming systems which attach colored toner or ink to a print surface of a print medium to form a color image or the like, and then discharges the print medium on which the image is formed. Of these printing apparatuses, printing apparatuses based on the ink jet system require only a small number of steps to form an image on a print medium; with the ink jet system, a print head ejects ink directly to a print medium. Accordingly, these printing apparatuses have the advantages of, for example, requiring only low running and manufacturing costs, being suitable for color printing, and making little noise during a printing operation. The ink jet printing apparatus thus gathers much attention in various markets for such printing apparatuses ranging from clerical to domestic ones. Thus, in recent years, output apparatuses to which the ink jet system is applied have been employed in a large number of image forming systems such as printers, facsimile machines, and copiers.

However, a variety of print media are used in a printing apparatus employing the ink jet system; the print media vary in the capability of absorbing ink. Thus, in the printing apparatus based on the ink jet system, with which image quality is significantly affected depending on the type of print media used, the type of the print media used is identified before a printing operation is started. Then, the printing operation is controlled on the basis of the result of the identification.

A well-known conventional method for identifying the type of print media irradiates the surface of a print medium with light to measure light regularly reflected by the print medium. This identifying method focuses on a variation in the surface roughness of print media to measure the quantity of light regularly reflected by each print medium. The method thus acquires glossiness data on the print medium and then compares the glossiness data acquired with prestored data on a threshold for the quantity of light regularly reflected. The method thus identifies the type of the print medium (Japanese Patent Application Laid-Open No. 06-015861 (1994)).

However, a variety of print media varying in surface smoothness or the type of coating agent are used for the printing apparatus based on the ink jet system in accordance with applications. Accordingly, when the method according to Japanese Patent Application Laid-Open No. 06-015861 (1994) is used to acquire the glossiness data on print media, the measured quantities of light regularly reflected by different types of print media may be equivalent to each other. Further, new types of print media will be developed in the future and tend to have various reflection characteristics. Accordingly, with an apparatus that identifies the types of print media using an identifying device that utilizes only visible light or infrared light, it is impossible to accurately identify the types of media having similar glossiness. This may result in an incorrect identification.

SUMMARY OF THE INVENTION

It is an object of the present invention to provide a print medium identifying device that can accurately detect various print media.

To accomplish this object, a first aspect of the present invention provides a print medium identifying device that identifies the type of a print medium used for a printing apparatus, the print medium identifying device being characterized by comprising a light emitting section that irradiates a surface of the print medium with ultraviolet light and different light having a longer wave than the ultraviolet light, a light receiving section that receives the light from the light emitting section which is reflected by the surface of the print medium to output a signal corresponding to the quantity of light received, and identifying means for identifying the type of the print medium on the basis of a signal output by the light receiving section when the print medium is irradiated with the ultraviolet light and a signal output by the light receiving section when the print medium is irradiated with the different light wherein the light emitting section is arranged such that an incident angle of the ultraviolet light is smaller than the incident angle of the other light.

Further, a second aspect of the present invention is a printing apparatus that forms an image by applying color materials to a print medium, the printing apparatus being characterized by comprising the print medium identifying device according to first aspect and control means for controlling predetermined operations related to a printing operation in accordance with the type of the print medium identified by the print medium identifying means.

A third aspect of the present invention is a printing apparatus comprising printing means for applying color materials to a print medium and conveying means for conveying the print medium, the printing apparatus performing a printing operation by using the conveying means to convey the print medium and using the printing means to apply the color materials to the print medium, the printing apparatus being characterized by comprising the print medium identifying device according to first aspect and control means for controlling the printing means and the conveying means in accordance with the type of the print medium identified by the print medium identifying means.

A fourth aspect of the present invention is a print medium identifying method of identifying the type of a print medium used for a printing apparatus, the method being characterized by comprising irradiating a surface of the print medium with ultraviolet light and different light having a longer wave than the ultraviolet light, both light being emitted by a light emitting section, receiving the light reflected by the surface of the print medium using a light receiving section that outputs a signal corresponding to the quantity of light received, and identifying the type of the print medium on the basis of a signal output by the light receiving section when the print medium is irradiated with the ultraviolet light and a signal output by the light receiving section when the print medium is irradiated with the different light.

The present invention can detect not only a light reflection characteristic attributed to the surface roughness or glossiness of the print medium but also the contents of a fluorescent agent contained in the print medium. Therefore, the present invention can accurately identify the type of the print medium on the basis of the results of the detections.

The above and other objects, effects, features and advantages of the present invention will become more apparent from the following description of embodiments thereof taken in conjunction with the accompanying drawings.

DETAILED DESCRIPTIOIN OF PREFERRED EMBODIMENTS

First Embodiment (Print Medium Identifying Device)

Figure 1:
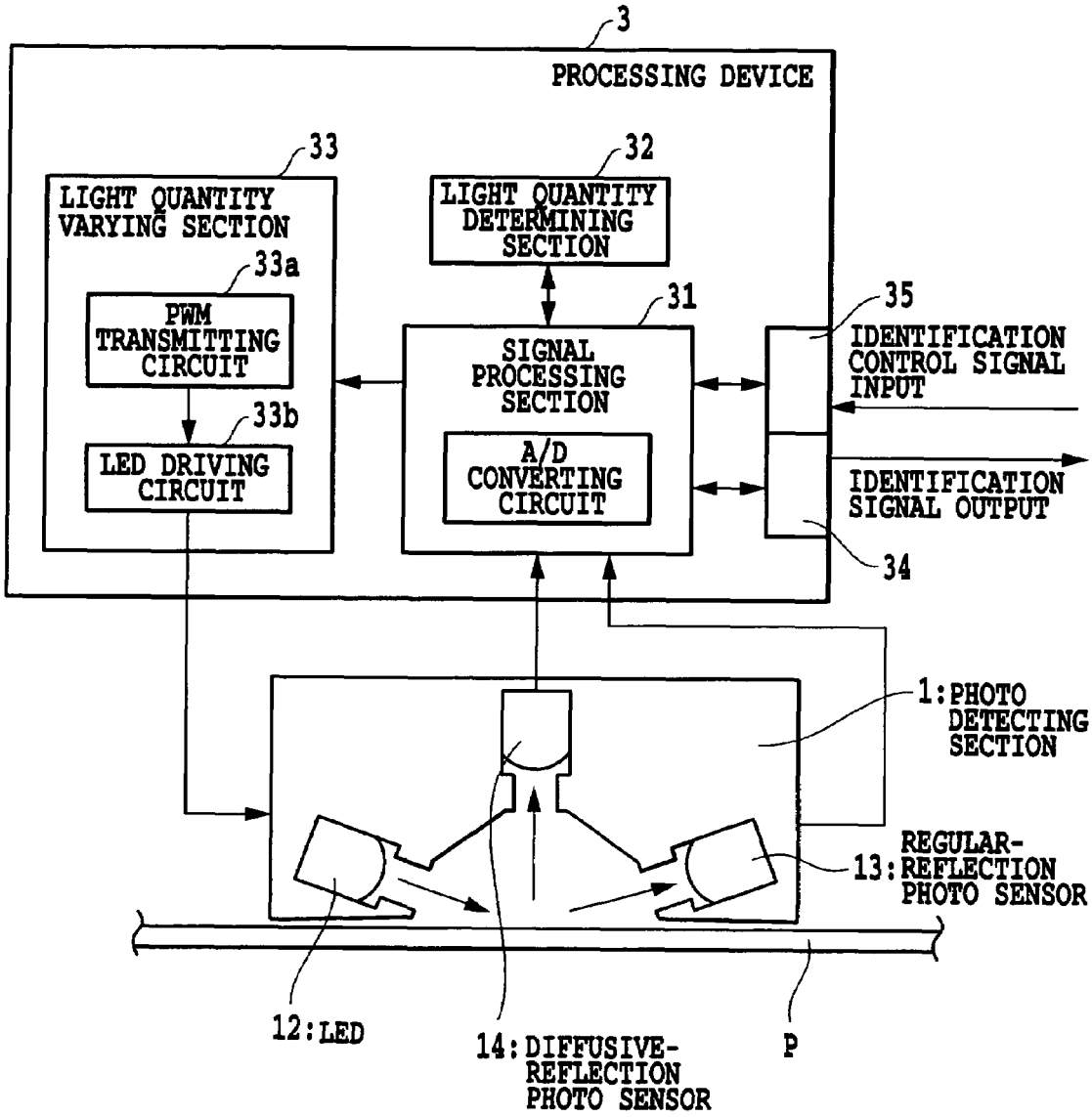
FIG. 1 is a diagram conceptually showing the configuration of a print medium type identifying device according to the present invention.

FIG. 1 is a diagram conceptually showing the configuration of a print medium identifying device according to the present invention.

As shown in FIG. 1, the print medium identifying device according to the present embodiment comprises a photo detecting section 1 and a processing device 3. The photo detecting section 1 has a light emitting section that irradiates a print medium to be identified, with light, and a light receiving section that receives light reflected by the print medium. The processing device 3 processes a signal from the photo detecting section 1 to identify the type of the print medium.

The light emitting section provided in the photo detecting section 1 is composed of a LED 12 in which an infrared light emitting section that emits infrared light and an ultraviolet light emitting section that emits ultraviolet light are housed in the same package. The LED 12 is placed so that infrared light and ultraviolet light emitted by the LED 12 are applied, at a predetermined incident angle, to a print medium P held flat at a predetermined print medium holding position.

The light receiving section provided in the photo detecting section 1 is composed of a regular-reflection photo sensor 13 that detects light (regularly reflected light) reflected at the same angle at which the light with which the print medium P has been irradiated is incident on the print medium P, and a diffusive reflection photo sensor 14 that detects light (diffuse- or scatter-reflected light) reflected at an angle different from that at which the light with which the print medium P has been irradiated is incident on the print medium P. Each of the photo sensors 13 and 14 is composed of a photoelectric converting element such as a photo diode which detects the quantity of infrared or ultraviolet light with which the surface of the print medium P is irradiated by the LED 12.

In this case, not only paper but also various print media such as cloths and plastic films can be identified by the print medium identifying device according to the present embodiment. Such print media also include a reflection reference sheet used as a reference to determine a threshold for determining the type of a print medium or used to calibrate the photo detecting section 1.

On the other hand, the signal processing device has a signal processing section 31, a light quantity determining section 32, a light quantity varying section 33, an identification control signal output section 34, and an identification signal input section 35. The signal processing section 31 transmits a control signal for a process of identifying the type of the print medium P and also transmits a control signal to each section of the photo detecting section 1, on the basis of output signals transmitted by the regular-reflection photo sensor 13 and diffusive reflection photo sensor 14 of the photo detecting section 1. The light quantity determining section 32 determines the quantity of light applied by the LED 12 so that the photo sensors 13 and 14 detect predetermined quantities of light. The light quantity varying section 33 varies an optical output provided by the LED in accordance with a control signal from the signal processing section 31 so as to provide the quantity of light determined by the light quantity determining section 32. The identification control signal output section 34 outputs an identification control signal output by the signal processing section 31 to applied equipment such as a printing apparatus. Various identification control signals transmitted by the applied apparatus are input to the identification signal input section 35.

In this case, the signal processing section 31 has, for example, a CPU that executes an arithmetic process and a control process, a RAM that temporarily stores data, a ROM that stores control programs and the like, and an A/D converting circuit that converts analog signals output by the photo sensors 13 and 14 into digital signals. Further, the light quantity varying section 33 consists of a PWM transmitting circuit 33*a* that transmits a pulse signal with a pulse width corresponding to a control signal transmitted by the signal processing section, and a LED driving circuit 33*b* that drives the LED in accordance with the pulse signal transmitted by the PWM transmitting circuit 33*a*.

The print medium identifying device configured as described above operates in unison with applied equipment such as a printing apparatus on the basis of an identification control output from the processing device 3 and an identification control input to the processing device 3.

In the print medium identifying device according to the embodiment configured as described above, the photo detecting section 1 first irradiates the print medium P with infrared light or ultraviolet light. The photo sensors 13 and 14 then detect the quantity of light reflected bya surface of the print medium P. The type of the print medium is identified on the basis of a detected value. Specifically, first, the print medium P is irradiated with infrared light from the LED 12. The regular-reflection photo sensor 13 receives regularly reflected light, while the diffusive reflection photo sensor 14 receives diffusively reflected light. The sensors 13 and 14 outputs signals (current or voltage values) corresponding to the quantities of light received. The signals are input to a CPU of the signal processing section 31 via the A/D convening circuit 31*a*. The CPU divides the detected value output by the regular-reflection photo sensor 13 by the detected value output by the diffusive reflection photo sensor 14. Then, as in the case of the detection of the quantity of light received when infrared light is applied, the photo sensors 13 and 14 receive the regular reflection and diffusive reflection of ultraviolet light applied by the LED 12 and output signals corresponding to the quantities of light received. In this case, the regular-reflection photo sensor 13 and the diffusive reflection photo sensor 14 may simultaneously detect the reflection of light applied by the LED 12 or separately detect regularly reflected light and diffusively reflected light by allowing the LED 12 to emit light a number of times.

Figure 2:
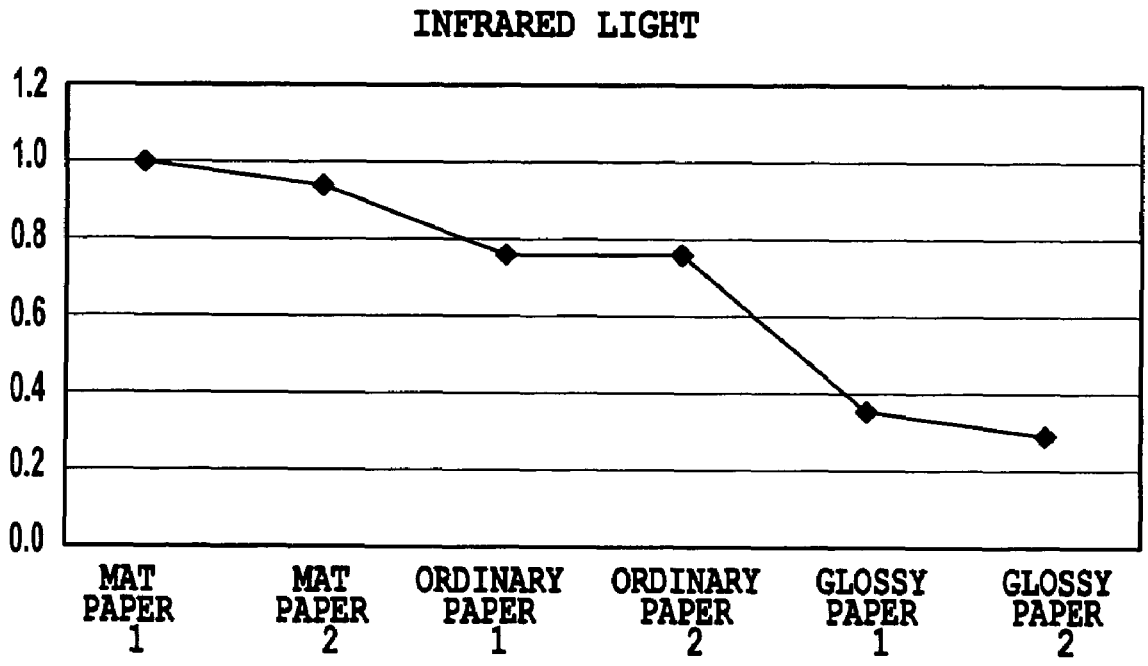
FIG. 2 is a diagram showing a graph showing a signal value obtained from a regular-reflection photo sensor divided by a signal value obtained from a diffusive reflection photo sensor when plural types of print media are irradiated with infrared light from a LED, according to a first embodiment of the present invention.

FIG. 2 is a diagram showing an output signal value from the diffusive reflection photo sensor 14 having received reflected light from the print medium P divided by an output signal from the regular-reflection photo sensor 13 when common plural types of print media used for ink jet printers are irradiated with infrared light from the LED 12 as described above. In this case, the print medium P used is ordinary paper 1, ordinary paper 2, glossy paper 1, glossy paper 2, mat paper 1, and mat paper 2. Quotients are determined from the quantity of regularly reflected light received and the quantity of diffusively reflected light received. The glossiness of the surface of the print medium P increases in order of the mat paper 1, mat paper 2, ordinary paper 1, ordinary paper 2, glossy paper 1, and glossy paper 2. The ordinary papers 1 and 2 have slightly different reflection characteristics, obtained by the regular-reflection photo sensor 13 and diffusive reflection photo sensor 14, but are of the same print medium type. Similarly, the glossy papers 1 and 2 have slightly different reflection characteristics but are of the same print medium type. The mat papers 1 and 2 have slightly different reflection characteristics but are of the same print medium type. It is an object of the present embodiment to accurately identify the types of print media so that the ordinary papers 1 and 2, which have slightly different reflection characteristics but are of the same print medium type, are identified as ordinary paper. The various types of print media are adapted for output images so as to provide a user's desired output results. Each of the print media has the following characteristics. The ordinary paper, which is often used in offices as copy sheets, exhibits pulp fibers constituting the paper on its surface. Thus, compared to the other print media, the ordinary paper has a rough, irregular, and less glossy surface. The mat paper and glossy paper is composed of paper as a base material on which a receiving layer is coated in order to allow ink to permeate more smoothly through the paper. In particular, the mat paper (or coat paper) helps exhibit vivid colors and is used to output graphic characters; the mat paper is a print medium composed of ordinary paper as a base material on which a pigment such as silica is coated. The mat paper has less unevenness regular but glossier surface than the ordinary paper. Further, the glossy paper is used to print photographic image and adapted to provide output results equivalent to glossily finished silver photographs. For the purpose of improving the smoothness of the surface of the print medium, multiple coating agent layers and receiving layers are coated on a base material. The glossy paper has a smoother and glossier surface than the other print media.

As shown in the figure, for a quotient (an output value from the diffusive reflection photo sensor/an output value from the regular-reflection photo sensor) calculated by the signal processing section 31, the value increases in order of the glossy paper 1, glossy paper 2, ordinary paper 1, ordinary paper 2, mat paper 1, and mat paper 2. As shown in FIG. 2, there are relatively large differences between the values obtained from the glossy papers 1 and 2 and the values obtained from the papers except the glossy papers. This is because the glossy papers 1 and 2 are smoother and glossier than the other papers and thus reduce the quantity of infrared light diffused over the print media, thus increasing the quantity of light received by the regular-reflection photo sensor 13, while reducing the quantity of light received by the diffusive reflection photo sensor 14.

Thus, in the present embodiment, a threshold (second threshold) is preset at a value between a quotient obtained from the glossy paper 1 or 2 and a quotient obtained from the ordinary paper 1 or 2. The device then determines whether or not the calculated quotient is at least the second threshold. The device thus determines whether the print medium irradiated with light is glossy paper 1 or 2 or another print paper.

As shown in FIG. 2, there is only a small difference between a quotient obtained from the ordinary paper 1 or 2 and a quotient obtained from the mat paper 1 or 2. Consequently, the ordinary papers 1 and 2 may not be distinguished from the mat papers 1 and 2.

Thus, according to the present embodiment, instead of using only the detected values obtained when the print medium is irradiated with infrared light to identify the print medium, the detected value obtained when the print medium is irradiated with ultraviolet light is also used to accurately distinguish the ordinary papers 1 and 2 from the mat papers 1 and 2.

Figure 3:
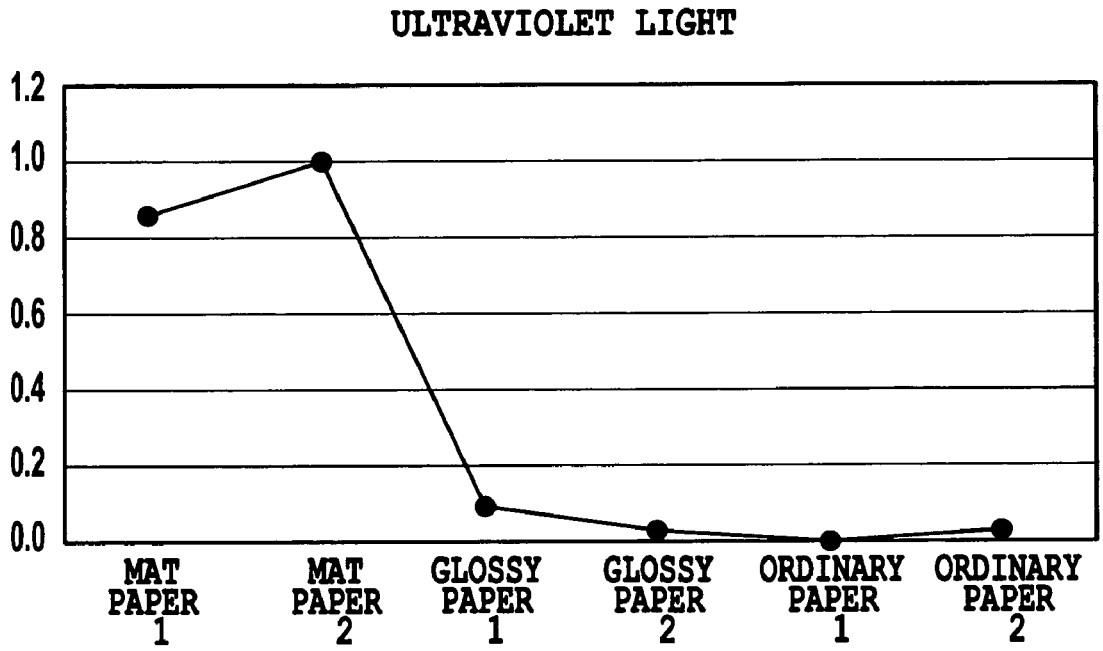
FIG. 3 is a diagram showing a graph showing a signal value obtained from the regular-reflection photo sensor divided by a signal value obtained from the diffusive reflection photo sensor when plural types of print media are irradiated with infrared light from the LED, according to a first embodiment of the present invention.

FIG. 3 is a diagram showing output signal values from the diffusive reflection photo sensor 14 having received reflected light from the print medium P when plural types of print media (ordinary paper 1, ordinary paper 2, glossy paper 1, glossy paper 2, mat paper 1, and mat paper 2) are irradiated with ultraviolet light from the LED 12.

As shown in the figure, there is a large difference between an output signal value obtained from the mat paper 1 or 2 and output signals value obtained from the other print media (ordinary papers 1 and 1 and glossy papers 1 and 2). This is because the mat papers 1 and 2 have their surfaces coated with a coating material (pigment such as silica) containing more fluorescent whitening agent than the other print papers. That is, when irradiated with ultraviolet light, the mat papers 1 and 2, containing more fluorescent whitening agent, emit more fluorescence. Consequently, the diffusive reflection photo sensor 14 receives more light (diffusively reflected light) containing a fluorescent component. In contrast, the glossy papers 1 and 2 and the ordinary papers 1 and 2 contain less fluorescent whitening agent than the mat papers 1 and 2.

Consequently, the diffusive reflection photo sensor 14 receives less light and outputs a reduced value to the signal processing section 31.

According to the present embodiment, a threshold for ultraviolet irradiation (first threshold) is preset at a value between an output value from the diffusive reflection photo sensor 14 which is obtained from the mat paper 1 or 2 and an output value from the diffusive reflection photo sensor 14 which is obtained from the glossy paper 1 or 2. The device then determines whether or not the output value acquired is at least the threshold. The device thus determines whether the print medium irradiated with light is mat paper 1 or 2 or another print paper. By generating print data corresponding to the print medium identified by the print medium identifying device, it is possible to carry out printing suitable for the type of the print medium. In this case, the printing apparatus identifies the type of the print medium. However, output results from the photo detecting section 1 of the printing apparatus may be transmitted to a host apparatus externally connected to the printing apparatus so that the type of the print medium can be identified by a program included in a print driver of the host apparatus.

By calculating quotients from the print medium P and determining a threshold on the basis of each of the quotients, it is possible to preset thresholds for detecting the type of the print medium, such as a threshold for infrared irradiation and a threshold for ultraviolet irradiation. However, it is possible to prepare such reference reflection sheets as provide appropriate thresholds for infrared irradiation and for ultraviolet irradiation so that quotients obtained from the reference reflection sheets can be preset as thresholds. These thresholds may be set by a user or before delivery. Further, according to the present embodiment, for ultraviolet irradiation, the type of the print medium is identified using only the output value from the diffusive reflection photo sensor 14. However, as in the case of infrared light irradiation, quotients obtained from the regular-reflection photo sensor 13 and diffusive reflection photo sensor 14 may be used to identify the print medium.

Figure 6:
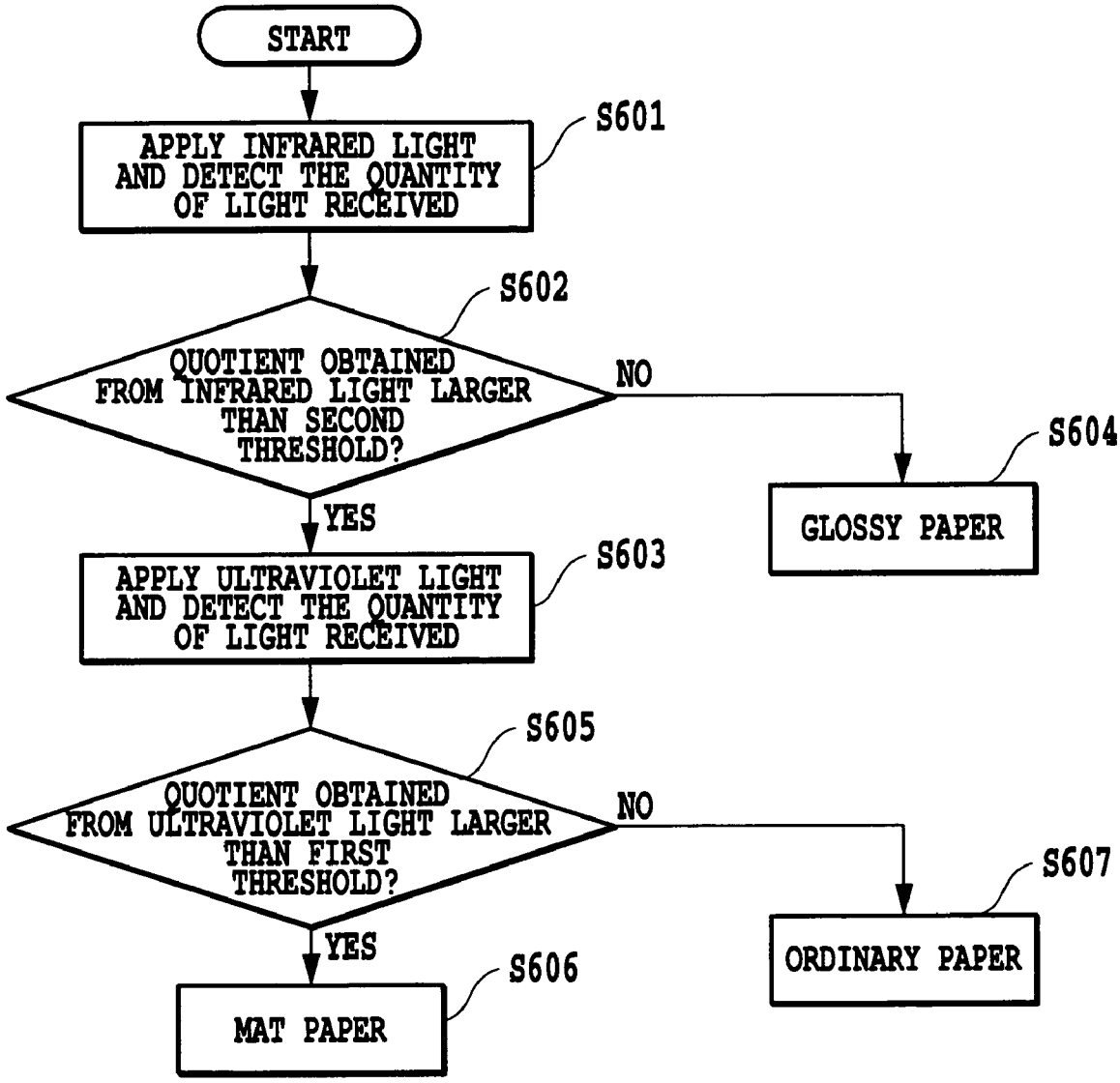
FIG. 6 is a flowchart showing a procedure of identifying the type of a print medium according to the embodiment of the present invention.

As described above, in the present embodiment, by irradiating the print medium with infrared light and ultraviolet light, it is possible to reliably determine whether the print medium is mat paper, ordinary paper, or glossy paper in accordance with the quantity of light reflected by the print medium. FIG. 6 is a flow chart showing the procedure of identifying the type of a print medium according to the present embodiment. In the flow chart shown in FIG. 6, the print medium is identified first using infrared light. However, infrared measurements may be made to determine whether the print medium is mat paper or not before ultraviolet measurements are made to determine whether the print medium is ordinary paper or glossy paper.

In the present embodiment, the regular-reflection photo sensor 13 and the diffusive reflection photo sensor 14 are used as a sensor that detects reflected light from the print medium so that the quotients of the values obtained from the sensors can be used to identify the type of the print medium. Consequently, if mist or paper dust adheres to the LED 12 or photo sensor 13 or 14, or an error in output characteristic or light reception characteristic results from a variation in temperature (environment) or a secular change, this can be eliminated to exhibit a favorable identification performance over a long period. However, the present invention is not limited to the use of the regular-reflection photo sensor 13 and diffusive reflection photo sensor 14. A single photoelectric converting element may be used providing that the quantities of reflected light can be detected for plural types of light (infrared light and ultraviolet light) applied by an irradiating section. The positions of the irradiating section and photo sensor can be appropriately set.

Further, if a threshold is preset to identify the type of the print medium as previously described, every time an operation is started to identify the type of a print medium used for actual printing, the photo detecting section 1 is used to detect a reference reflection sheet having a predetermined reflection characteristic. Then, on the basis of the detected value, the threshold or an output from the photo detecting section 1 is corrected (calibrated) This makes it possible to appropriately identify the type of the print medium over a long period. For the purpose of reducing the time required for a type identifying operation of the print medium, calibration may be carried out when the printing apparatus is powered on or every time a predetermined number of type identifying operations are performed, rather than every time a single type identifying operation is performed.

In the above embodiment, a resin having an optical filter characteristic that blocks a particular wavelength region is used for a package of the regular-reflection photo sensor 13 and diffusive reflection photo sensor 14 of the photo detecting section 1 so as to transmit only the infrared light and ultraviolet light, while blocking light of the other wavelength regions. Then, output signals from the photo sensors 13 and 14 can be obtained more stably. Preferably, the wavelength regions to be blocked are, for example, 480 nm on a shorter wave side and 730 nm on a longer wave side. In the present embodiment, the photo sensors 13 and 14, which measure the quantity of light reflected by the print medium when it is irradiated with infrared light or ultraviolet light, have a sufficient sensitivity to detect infrared light and ultraviolet light. Either the regular-reflection photo sensor 13 or diffusive reflection photo sensor 14 may be obtained by combining a sensor having a sufficient sensitivity only for infrared light and a sensor having a sufficient sensitivity only for ultraviolet light. Further, in order to receive light excited by a fluorescent component contained in the print medium when it is irradiated with ultraviolet light, a 410-nm short-wave cut filter may be used to block ultraviolet light irregularly reflected by the print medium. The light excited by the fluorescent component has a wavelength different from that of applied light. Accordingly, only the excited light can be received by using the filter that blocks the wavelength region of ultraviolet light.

Further, in the above embodiment, the light emitting section is the LED in which the infrared light emitting section and the ultraviolet light emitting section are housed in a single package. However, it is possible to separately arrange a LED emitting infrared light and a LED emitting ultraviolet light. Furthermore, it is also possible to arrange processing sections such as an arithmetic section and a storage section at optimum positions for the incorporated equipment, the processing sections constituting the signal processing section.

Moreover, in the description of the above embodiment, the print medium is irradiated with ultraviolet light and infrared light. However, the print medium may be irradiated with ultraviolet light and visible light. In this case, the type of the print medium can be identified in accordance with the quantity of light reflected by the print medium as in the case of the above embodiment. Specifically, the type of the print medium can be identified in accordance with the quantity of light reflected when the print medium is irradiated with ultraviolet light (ultraviolet rays: about 10 to 380 nm) and visible light having a longer wave than ultraviolet light (visible light: about 380 to 780 nm) or infrared light (infrared light: about 780 nm to 100 μm).

(Printing Apparatus)

Figure 4:
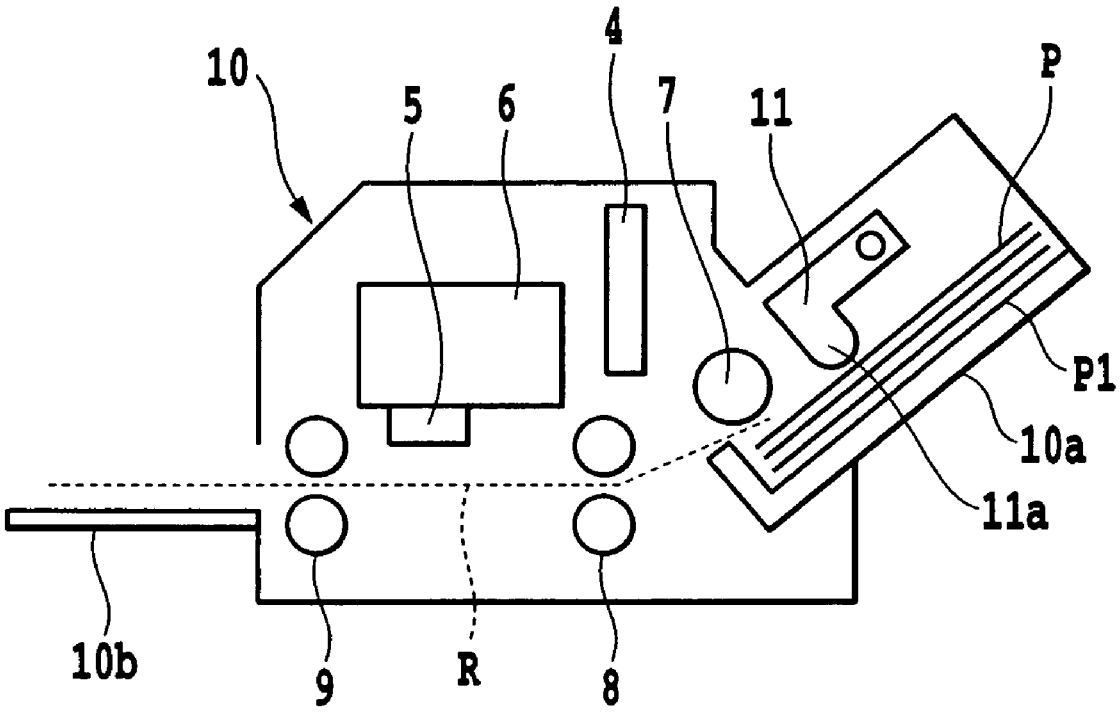
FIG. 4 is a sectional view conceptually showing the configuration of a printing apparatus according to an embodiment of the present invention.

Now, with reference to FIG. 4, description will be given of an example of a printing apparatus into which the above print medium type identifying device is incorporated.

In the figure, reference numeral 10 denotes an ink jet printing apparatus. The ink jet printing apparatus 10 is of a serial printer type that performs a printing operation (ink ejecting operation) while reciprocating an ink jet print head (simply referred to as a print head below) in a direction orthogonal to the conveyance direction of a sheet together with a carriage 6, the ink jet print head ejecting ink. Further, the ink jet printing apparatus 10 is provided a sheet feeding roller 7 that sequentially feeds a plurality of print medium P stacked in a print medium loading section 10*a*, to a conveying path R, a conveying roller 8 that intermittently convey the print medium fed into the conveying path R, to a position opposite to the print head 5, and a sheet discharging roller 9 that conveys the print medium recorded by the print head 5, to a sheet discharging section 10*b*.

Further, reference numeral 11 denotes a sensor arm installed above the print medium stacking section 10*a*. A sensor head 11*a* is placed at the tip of the sensor arm 11 opposite a loading surface of the print medium loading section 10*a*. The sensor head 1l*a* is provided with the LED 12, the regular-reflection photo sensor 13, and the diffusive reflection photo sensor 14 similarly to the photo detecting section 1, shown in FIG. 1 (see FIG. 5). The LED 1 of the sensor head 1l*a* irradiates the uppermost print medium P stacked on the print medium stacking section 10*a*. The regular-reflection photo sensor 13 and the diffusive reflection photo sensor 14 receive light reflected by the uppermost print medium P.

Further, a reflection reference sheet P1 is installed at the bottom of the print medium loading section to calibrate the photo detecting section 1. If no print media are loaded on the print medium loading section 10*a*, the print medium type identifying device is calibrated. Specifically, the reflection reference sheet P1 is irradiated with light from the LED 12. Then, on the basis of detected values from the diffusive reflection photo sensor 14 and regular-reflection photo sensor 13 having received reflected light, an error in the detection performance of the photo sensors 13 and 14 is calculated. Then, in accordance with the calculated error, correction is made of, for example, the threshold set to identify the type of the print medium. In the figure, reference numeral 4 denotes a circuit board held in the printing apparatus and including a part or all of a control system that controls each section of the printing apparatus as well as a processing device.

Figure 5:
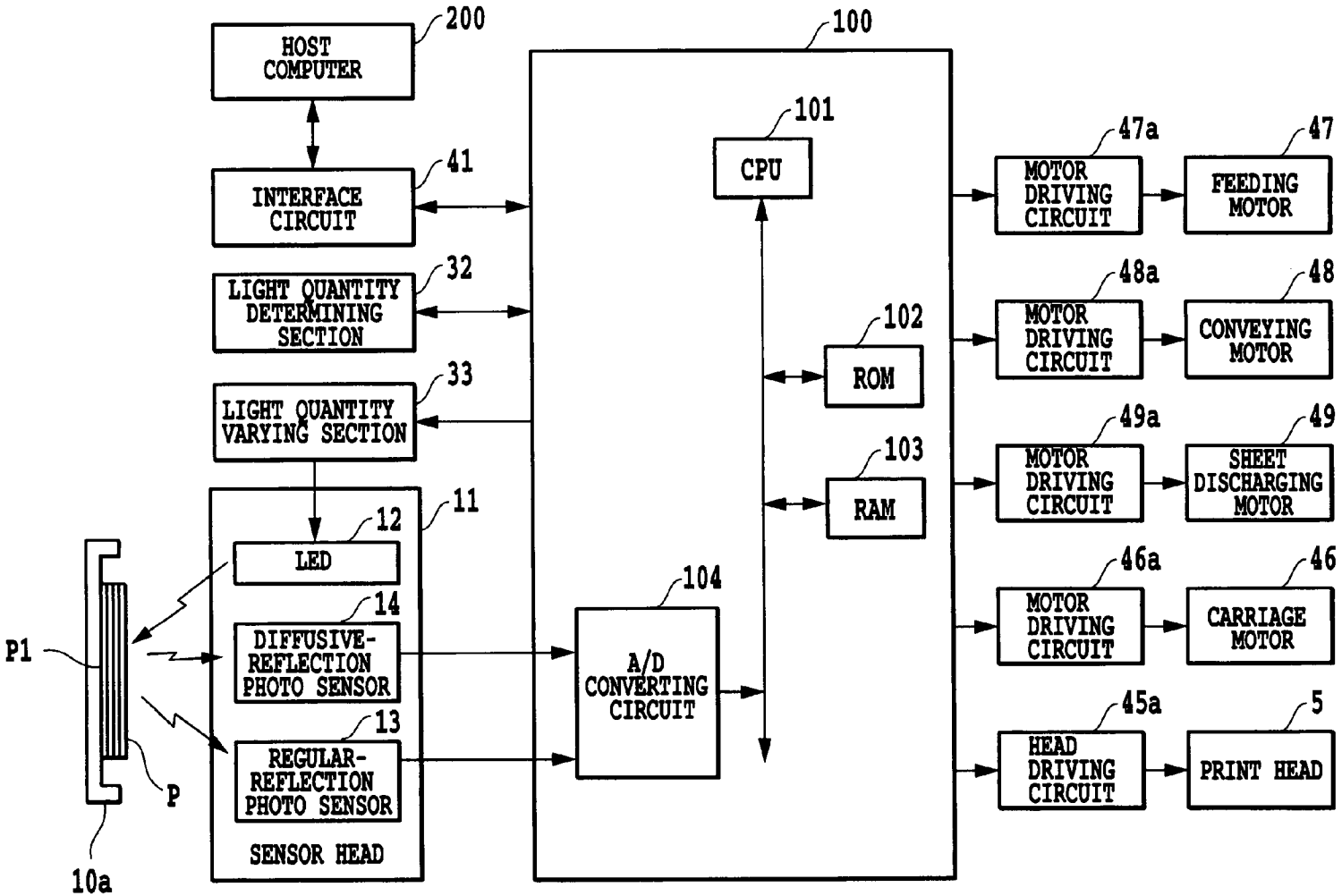
FIG. 5 is a block diagram schematically showing the configuration of a control system of the printing apparatus according to the embodiment of the present invention.

FIG. 5 is a block diagram schematically showing the configuration of a control system that controls a printing operation of the printing apparatus.

In FIG. 5, reference numeral 100 denotes a control section of the printing apparatus. The control section 100 has a CPU 101 that executes various processes such as calculations, determinations, and control, a RAM 103 having, for example, an area in which data associated with a processing operation of the CPU 101 is stored and an area in which input data is temporarily stored, a ROM 102 in which control programs controlled by the CPU 101 are stored, an A/D converting circuit 104, an I/O section (not shown), and the like.

Further, the control section 100 connects to a motor driving circuit 47*a* that drives a feeding motor 47 rotating the feeding roller 7, a motor driving circuit 48*a* that drives a conveying motor 48 rotating the conveying roller 8, a motor driving circuit 49*a* that drives a sheet discharging motor 49 rotating the sheet discharging roller 9, a motor driving circuit 50 that drives a carriage motor 46 driving the carriage 6, which reciprocates while holding the print head 5, and a head driving circuit 45*a* that drives the print head 5. Moreover, the control section 100 connects to the light quantity varying section 33 and light quantity determining section 32 of the print medium identifying device mounted in the ink jet printing apparatus according to the present embodiment. The photo detecting section 1 is connected to the light quantity varying section 33 and A/D convening section circuit 104.

Further, reference numeral 41 denotes an interface circuit connected to the control section 100 to transmit and receive signals to and from a host computer 200 via the interface circuit 41.

The print medium identifying device mounted in the inkjet printing apparatus is composed of the photo detecting section 1 and the processing device 3, similarly to the one shown in FIG. 1. The signal processing section 31 of the processing device is composed of the CPU 101, ROM 102, and RAM 103, which constitute the control section 100, and the A/D converting circuit 104.

In the printing apparatus configured as described above, when print media have been stacked in the print medium stacking section 10*a*, the uppermost one of the plurality of print media stacked in the print medium stacking section 10*a* is irradiated with infrared light and ultraviolet light emitted by the LED 12 as in the case of the print medium identifying device described in FIGS. 1 to 3. The CPU 101 divides an output value from the diffusive reflection photo sensor 14 by an output value from the regular-reflection photo sensor 13. The CPU 101 then compares the quotient obtained with a preset threshold to identify the type of the print medium P stacked on the print medium stacking section 10*a*. After identifying the type of the print medium P, the CPU 101 selects a form suitable for the print medium P and controls the motors 47, 48, and 49, the print head 5, and the like in accordance with the form. The CPU 101 performs a printing operation by controlling at least one of the amount of ink ejected to a unit area of the print medium P and the amount of ink ejected to the print medium during a unit time.

For example, glossy paper is suitable for the formation of a high-quality image like a photograph and absorbs ink well. Accordingly, for the glossy paper, an image is formed by increasing the amount of ink ejected to the unit area so as to obtain clear gradation (density). In this case, for the purpose of ejecting plural droplets of ink to the same pixel for gradation, an ink ejecting operation and an operation of conveying the print medium are preformed so as to reduce the amount of ink ejected to the unit area during the unit time. A specific printing form is multipass printing with a relatively large number of passes. For mat paper, which absorbs ink well, multipass printing with a relatively small number of passes or 1-pass printing is executed in order to increase a printing operation speed. Moreover, for ordinary paper, which is used to print documents containing characters and requiring a high throughput and which does not absorb ink well, the amount of ink ejected to the unit area is reduced to execute multipass printing with a relatively small number of passes or 1-pass printing. The 1-pass printing completes a predetermined print range of an image by causing the print head to perform one print scan. The multipass printing completes a predetermined print range of an image by causing the print head to perform a number of print scans. The number of passes refers to the number of print scans executed to complete a predetermined print range of an image.

Thus, according to the printing apparatus of the present embodiment, the identifying device accurately identifies the type of the print medium and the form of a printing operation is determined in accordance with the result of the identification. Consequently, even if various print media are mixed in the print medium stacking section 10*a*, an appropriate image can be formed using a printing form corresponding to each print medium.

The result of the identification by the print medium type identifying device may be used as a judging factor in selecting the best printing form. For example, the result of the identification by the print medium type identifying device may be used as a factor determining the printing form, together with a printing speed and print quality requested by the user. Then, the printing form can be determined by comprehensively judging these factors.

Further, it is possible to identify the type of a print medium fed from the print medium stacking section 10*a* or the like to determine whether or not the print medium being fed from the print medium stacking section matches the type of the print medium to be used for printing. Then, if the print medium being fed is of a different type, it is possible to stop a series of printing operations including a sheet feeding operation and causes an error to be displayed in a display section of the printing apparatus or the host computer, connected to the printing apparatus. This makes it possible to avoid performing an unwanted printing operation.

Further, in the present embodiment, both ordinary papers 1 and 2 are classified into ordinary paper and only the type of the print medium is identified. However, detailed measurements may be made to identify different print media of the same type. In this case, the detailed measurements may be made by varying the intensity of light with which the print medium is irradiated or improving the sensitivity of the photo sensors.

The above embodiment is only illustrative and does not limit the present invention. The print medium type identifying device according to the above embodiment uses as a light source the LED in which both infrared and ultraviolet light emitting sections are housed in one package. However, it is possible to separately arrange a LED emitting infrared light and a LED emitting ultraviolet light. It is also possible to arrange the processing sections such as the arithmetic section and storage section at optimum positions for the incorporated equipment, the processing sections constituting the signal processing section.

Moreover, in the description of the above embodiment, the print medium identifying device according to the present invention is applied to the serial printer type ink jet printing apparatus. However, the print medium identifying device according to the present invention is applicable to a line printer type ink jet printing apparatus or a printing apparatus based on an electrophotographic system or a wire dot system.

Second Embodiment

The present embodiment defines the arrangement of the LED 12 and photo sensors (light receiving elements) 13 and 14 of the print medium identifying device.

Figure 7:
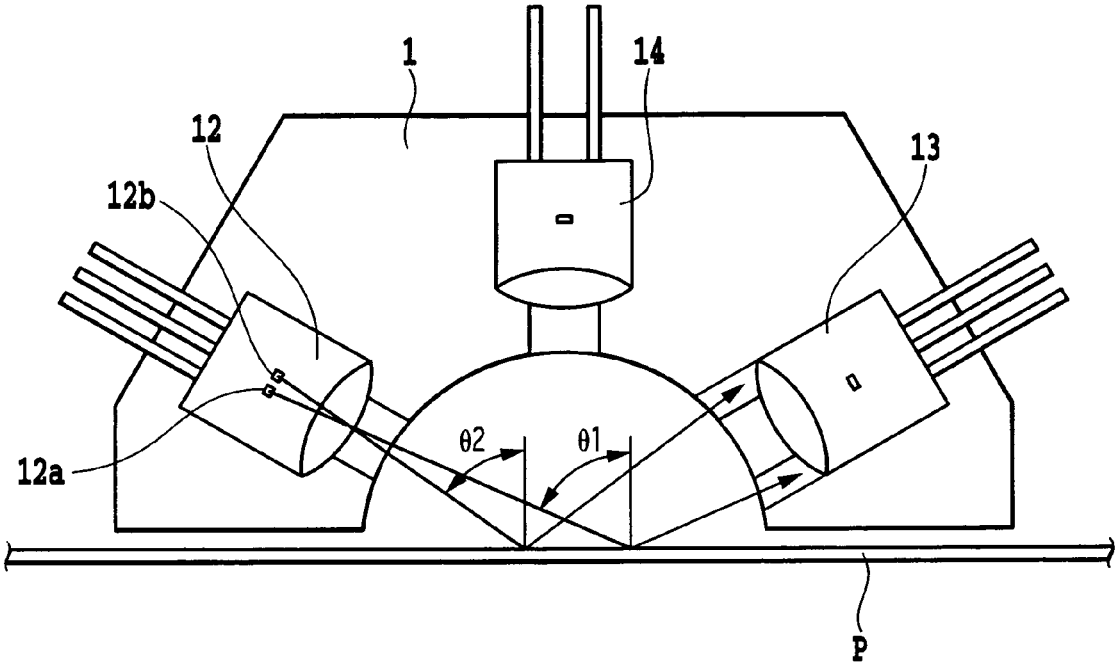
FIG. 7 is a diagram showing the configuration of a photo detecting section of a print medium type identifying device according to a second embodiment of the present invention.

FIG. 7 shows the configuration of a photo detecting section of a print medium type identifying device according to the present embodiment.

The same parts as those of the first embodiments are denoted by the same reference numerals. In the present embodiment, the LED 12, which applies ultraviolet or infrared light, comprises a chip emitting the corresponding light. Reference numeral 12*a* denotes an infrared chip that emits infrared light. Reference numeral 12*b* denotes an ultraviolet chip that emits ultraviolet light. If separate chips are used to emit a plurality of lights, the incident angle (the angle of an optical axis from a direction perpendicular to the surface of the print medium P) of light emitted by each chip varies depending on the position at which the chip is installed. A shown in FIG. 7, the incident angle of light applied by the infrared chip 12*a* is defined as θ1 (θ1 in FIG. 7 will also be referred to as an incident angle). The incident angle of light applied by the ultraviolet chip 12*b* is defined as θ2. The incident angle θ1 is larger than the incident angle θ2. The regular-reflection photo sensor 13 and the diffusive reflection photo sensor 14 are preferably provided at positions where both of them can receive ultraviolet light or infrared light even if the incident angles of these lights differ slightly. The configuration of the device except for the photo detecting section is the same as that of the first embodiment. Accordingly, its detailed description is omitted.

Figure 8:
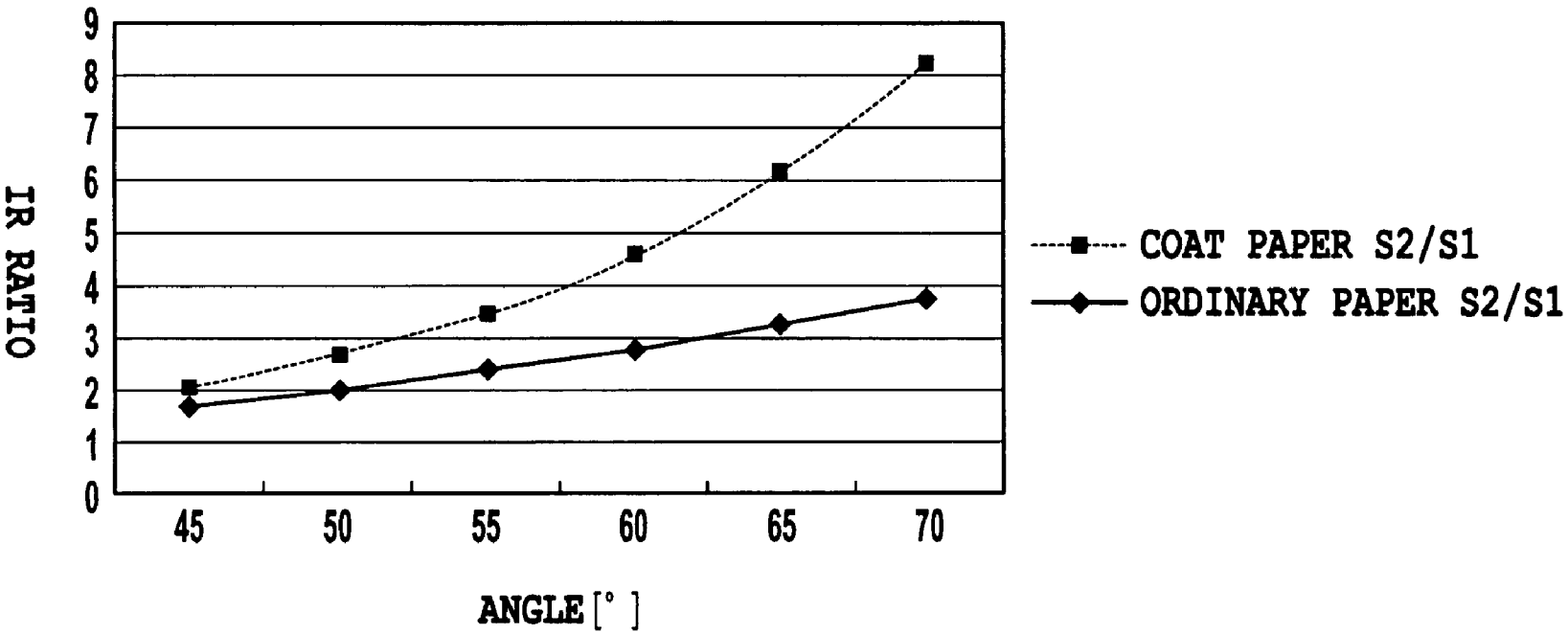
FIG. 8 is a diagram showing incident angles obtained when print media are irradiated with infrared light vs. a reflection characteristic according to the second embodiment of the present invention.

FIG. 8 is a diagram showing the quantity of light reflected when the print medium is irradiated with infrared light using a different incident angle.

FIG. 8 shows the ratio (IR ratio) of the quantity of regularly reflected light to the quantity of diffusively reflected light at different incident angles; coat paper and ordinary paper, which are erroneously identified because of their similar reflection characteristics observed when they are irradiated with infrared light and visible light. The ratio of the quantity of diffusively reflected light to the quantity of ultraviolet light is the detected value (S2) from the diffusive reflection photo sensor 14 divided by the detected value (S1) from the regular-reflection photo sensor 13. As seen in FIG. 8, the IR ratio for the coat paper and ordinary paper increases consistently with the incident angle. Thus, by arranging the LED and the photo sensors so as to increase the incident angle θ1, it is possible to accurately distinguish the coat paper from the ordinary paper.

Figure 9:
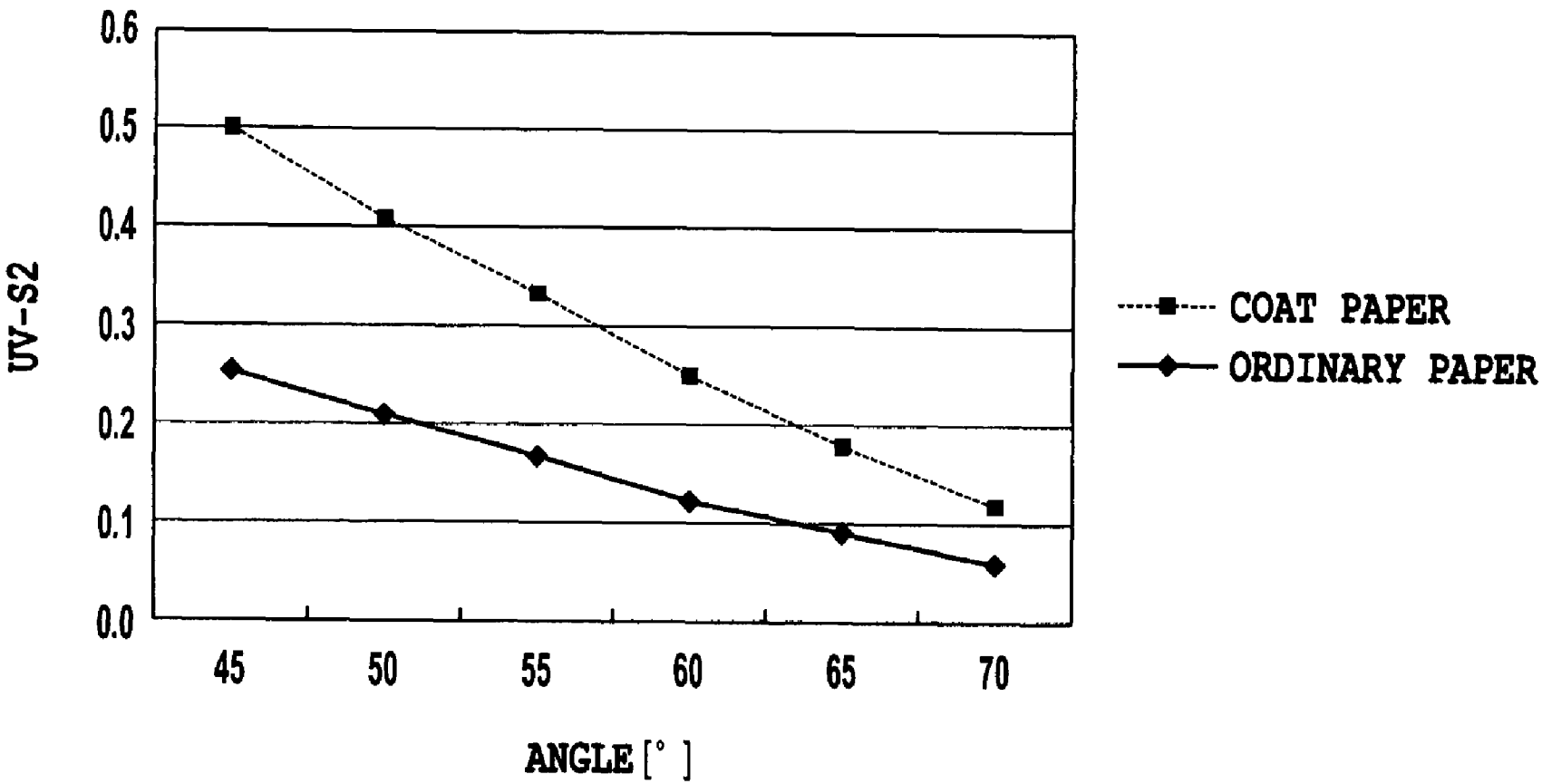
FIG. 9 is a diagram showing incident angles obtained when print media are irradiated with infrared light vs. a reflection characteristic according to the second embodiment of the present invention.

FIG. 9 is a diagram showing the quantity of light reflected when the print medium is irradiated with ultraviolet light using a different incident angle.

FIG. 9 shows the quantity of diffusively reflected light (S2) at different incident angles; coat paper and ordinary paper are irradiated with ultraviolet light (UV) using different incident angles. As seen in FIG. 9, the difference in the quantity of diffusively reflected light between the coat paper and ordinary paper increases with decreasing incident angle. Thus, by arranging the LED and the photo sensors so as to increase the incident angle 02, it is possible to accurately distinguish the coat paper from the ordinary paper.

As described above, according to the present embodiment, if different members are used to apply ultraviolet light and infrared light, the type of the print medium can be accurately identified by arranging the light emitting members so that the infrared light has a larger incident angle than the ultraviolet light.

In the present embodiment, as in the first embodiment, the type of the print medium can be identified using ultraviolet light and light having a longer wave than the ultraviolet light (infrared light, visible light, or the like).

With reference to FIG. 9, description has been given of the relationship between the incident angle and the quantity of diffusively reflected light. However, it is also possible to use the ratio of the quantity of regularly reflected light to the quantity of diffusively reflected light. By using the ratio of the quantity of regularly reflected light to the quantity of diffusively reflected light, it is possible to reduce a secular change in LED or light receiving elements and an error resulting from a change in environment.

Other Embodiments

Figure 10:
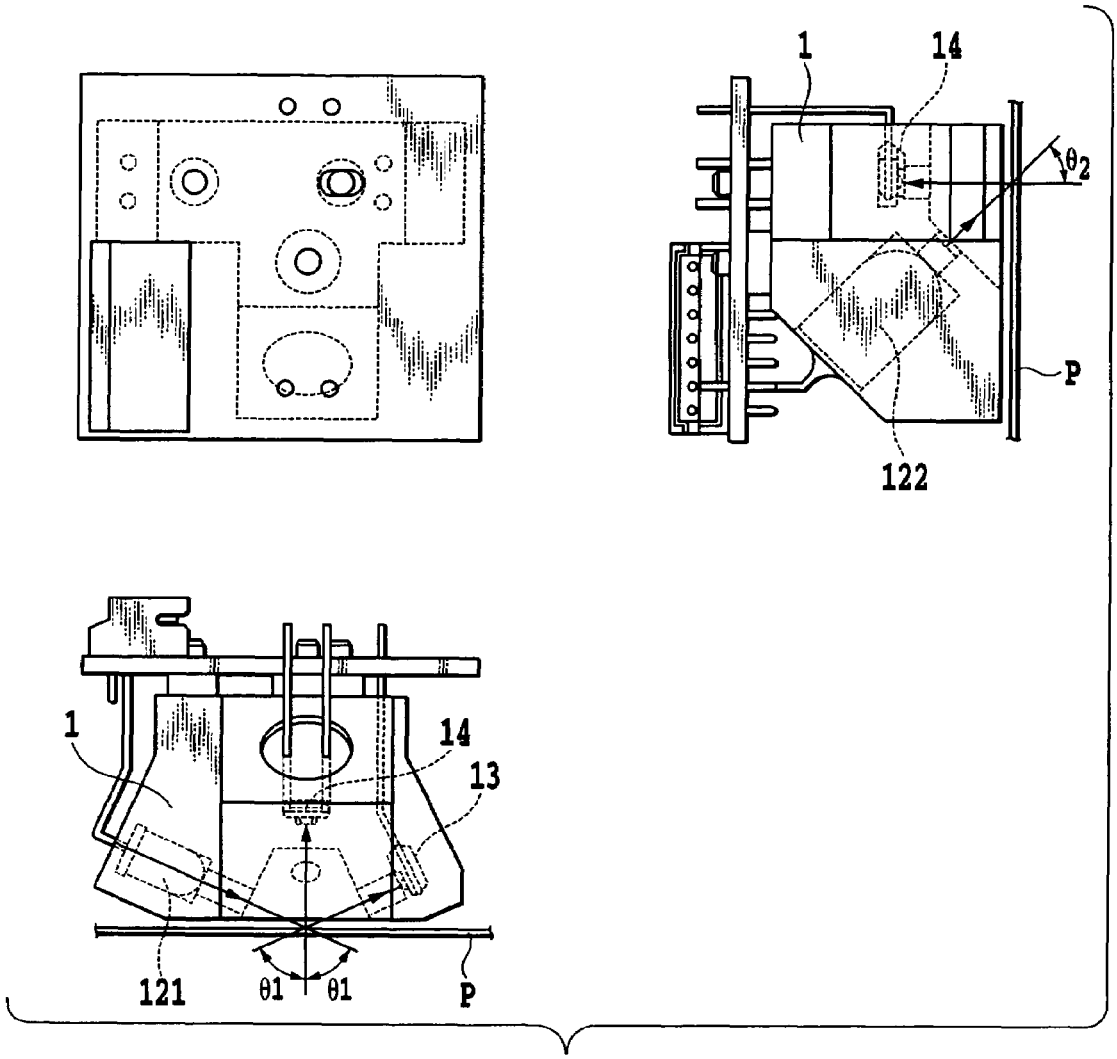
FIG. 10 is a diagram of a print medium identifying device according to another embodiment of the present invention as viewed from three directions.

FIG. 10 is a diagram showing a print medium identifying apparatus according to another embodiment.

FIG. 10 shows an example in which a LED 121 applying infrared light and a LED 122 applying ultraviolet light are separately arranged. In FIG. 10, only the diffusively reflected light in the reflection of the ultraviolet light is received. By arranging the LEDs 121 and 122 as shown in the figure, a common sensor can be used for both photo sensors 13 and 14. This configuration enables the use of a normal LED applying infrared or ultraviolet light instead of a unit that applies both infrared light and ultraviolet light. This serves to reduce costs. Further, the use of a common light receiving element enables a reduction in the size of the apparatus.

Figure 11:
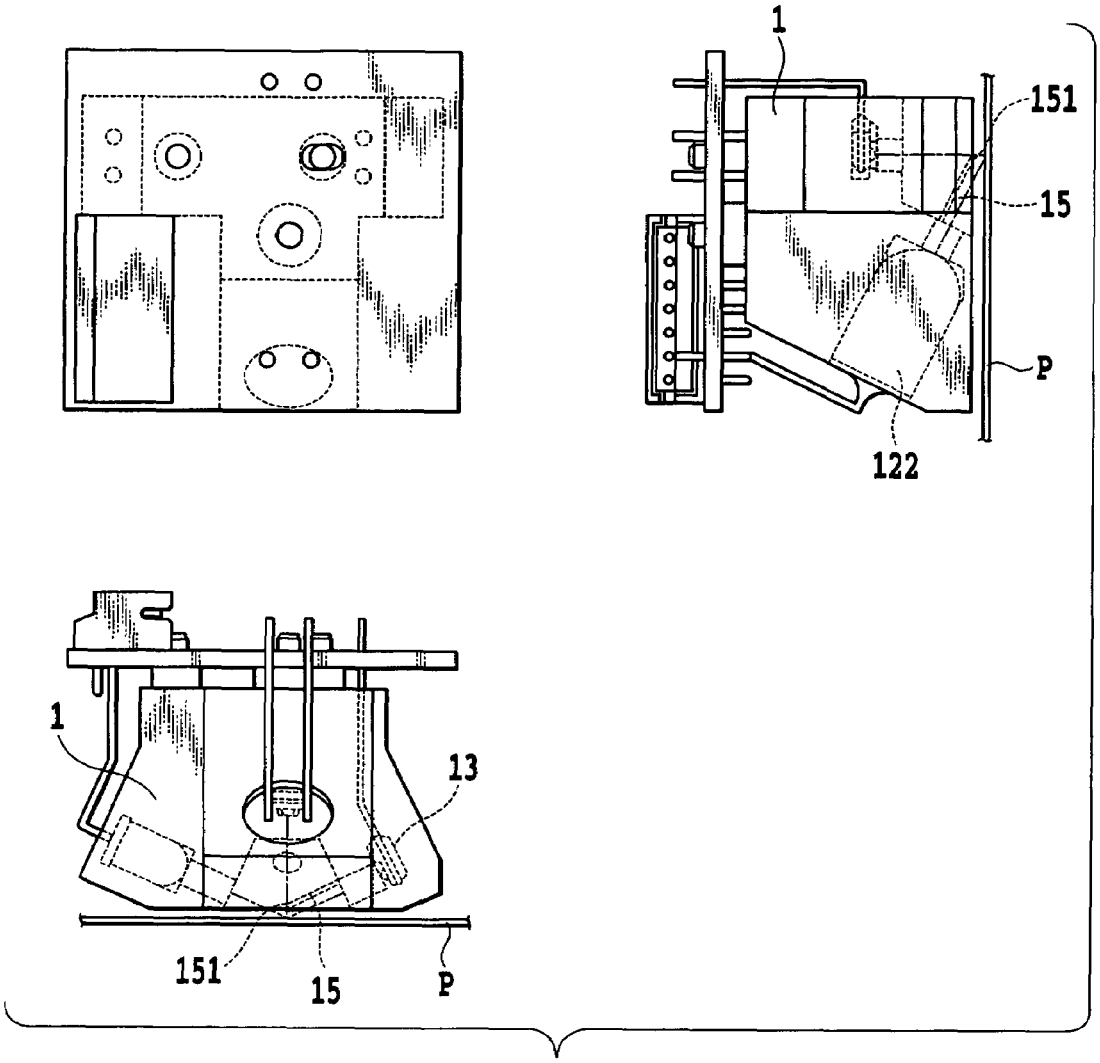
FIG. 11 is a diagram of a print medium identifying device according to yet another embodiment of the present invention as viewed from three directions.

FIG. 11 is a diagram of a print medium identifying device according to another embodiment. Reference numeral 15 in FIG. 11 denotes a light conducting member such as a transparent plastic member. The light conducting member captures part of light from the ultraviolet LED 122. A reflecting section 151 then changes the direction of the light. Then, the regular-reflection photo sensor 13 can receive the light. By thus using the regular-reflection photo sensor to receive light guided by the light guiding member, it is possible to reduce an error such as a secular change or a change in environment. Specifically, the error can be reduced by calculating the ratio of the quantity of ultraviolet light received by the regular-reflection photo sensor to the quantity of diffusively reflected light.

Figure 12:
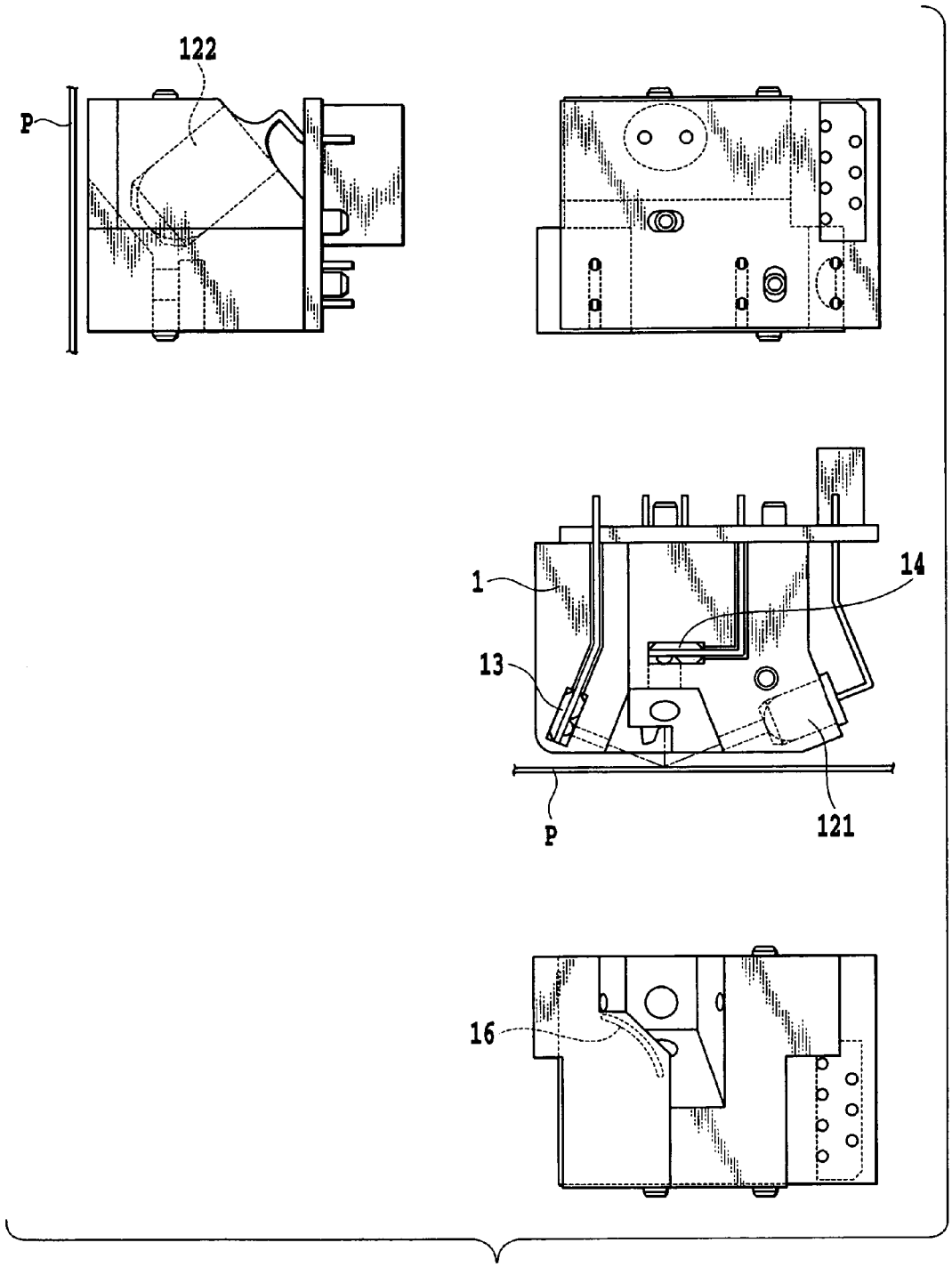
FIG. 12 is a schematic diagram of a print medium identifying device according to still another embodiment of the present invention.

Further, as shown in FIG. 12, in the configuration using the light guiding member, the regular-reflection photo sensor 13 can efficiently receive part of light from the ultraviolet LED 122 when PMMA is used as a core member of the light guiding member and when a plastic optical fiber 16 consisting of a fluorine-based resin is used as a clad material. Even if the light conducting member is used to guide part of applied ultraviolet light to the regular-reflection photo sensor, the regular-reflection photo sensor may receive light diffusively reflected by the surface of print medium. In this case, the quantity of light applied can be accurately determined by subtracting the quantity of diffusively reflected light from the output value from the regular-reflection photo sensor. This makes it possible to further reduce the error.

Figure 13:
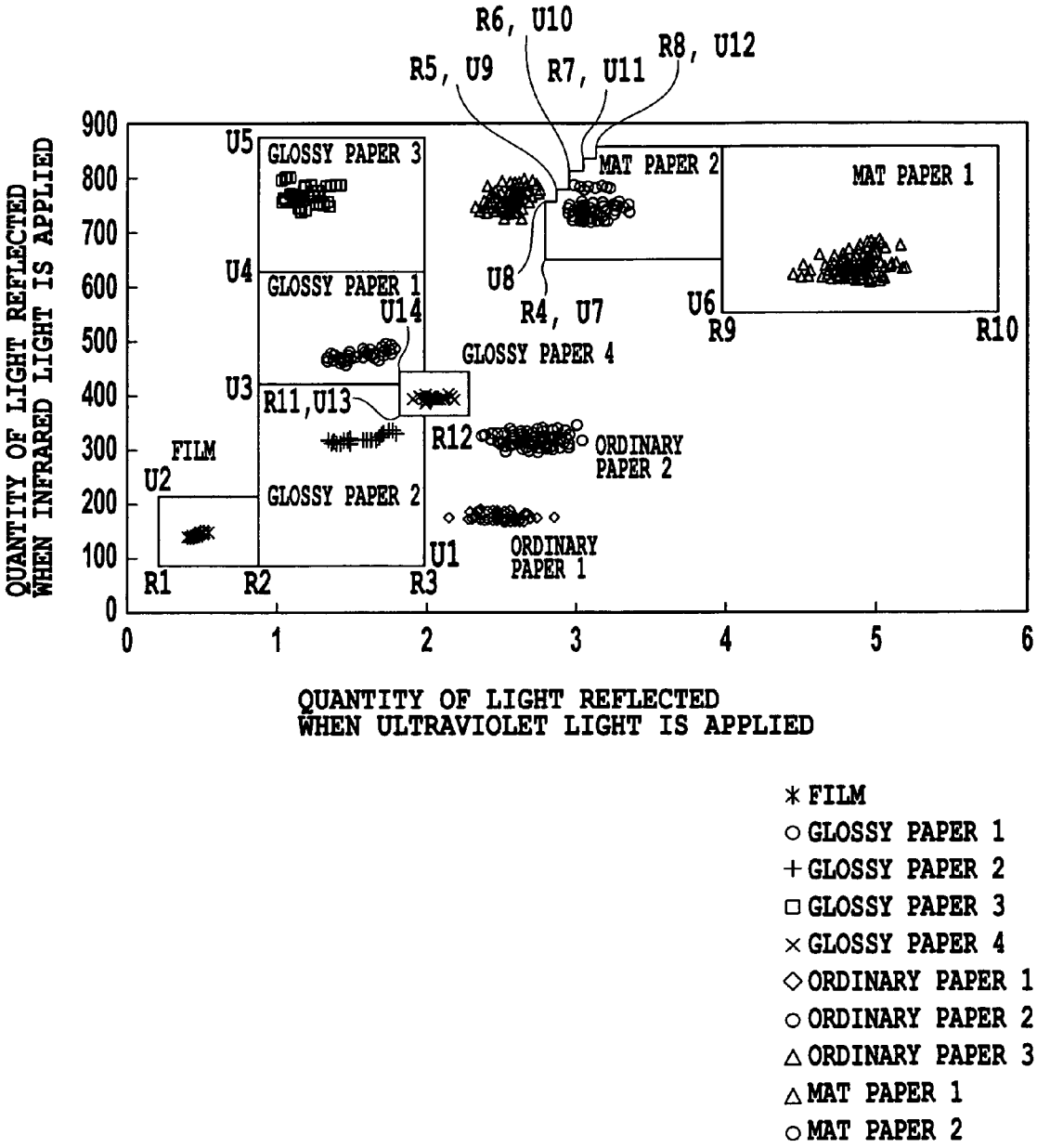
FIG. 13 is a diagram showing the relationship between various types of print media and their reflected light characteristic.
Figure 14:
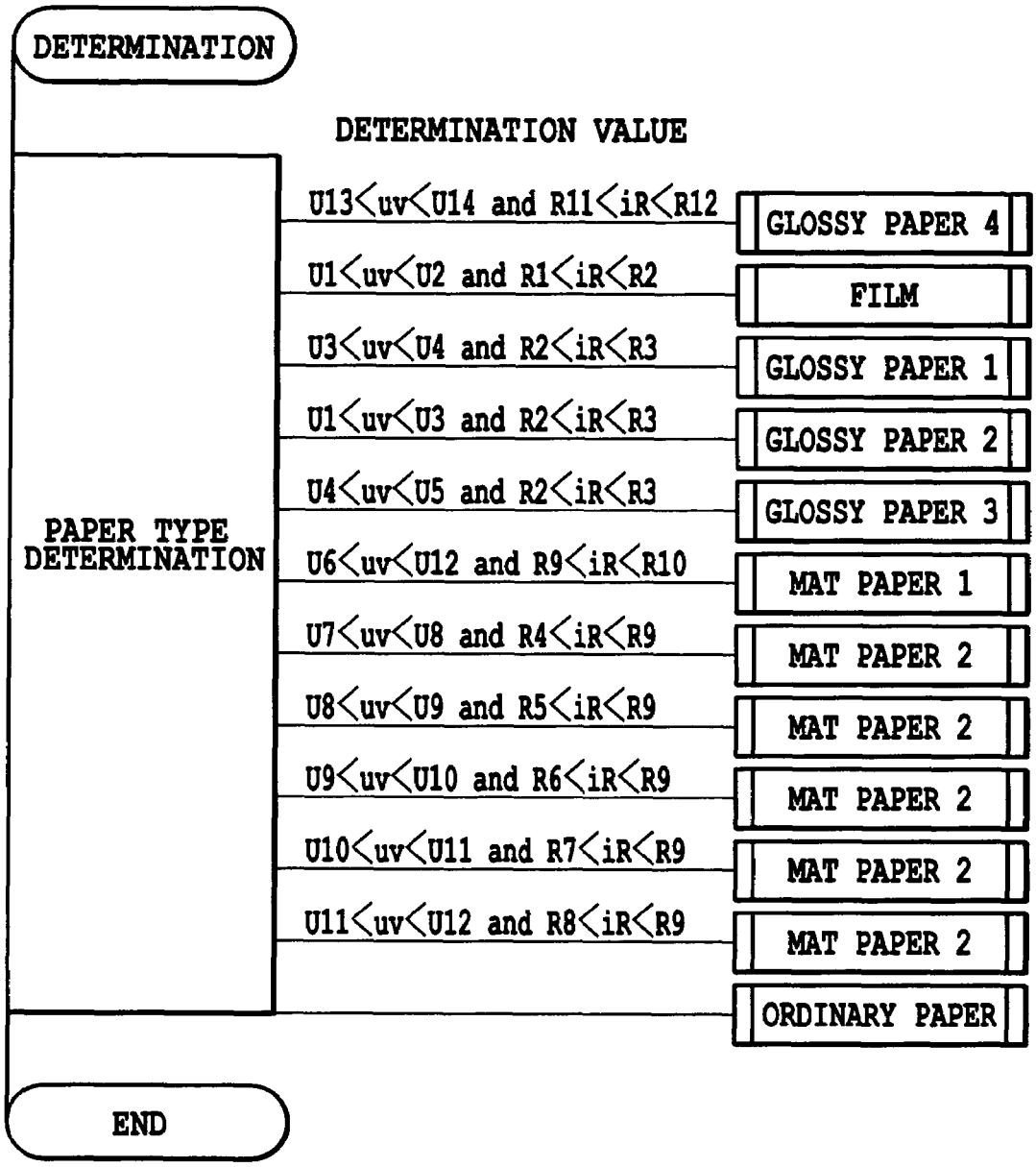
FIG. 14 is a flowchart showing a method for identifying the type of a print medium according to further another embodiment of the present invention.

Moreover, in the other embodiments of the present invention, both glossy papers 1 and 2 are classified into glossy paper and are not distinguished from each other. However, a more detailed classification may be made if possible. The more detailed identification of the types of print media enables the output of an image suitable for the more detailed type of a print medium. FIG. 13 is a diagram showing the reflection characteristic of various types of print media. In FIG. 13, the various print media having different reflection characteristics include glossy film, glossy paper 1, glossy paper 2, glossy paper 3, glossy paper 4, ordinary paper 1, ordinary paper 2, ordinary paper 3, mat paper 1, and mat paper 2. FIG. 14 is a flowchart used to determine the type of the print medium in detail. In FIG. 13, the possible range of reflection characteristic of each print medium is enclosed by a rectangle. Reference character RN (N=1 to 10) denotes the possible range of a value obtained from the photo sensor 13 or 14 when each print medium is irradiated with infrared light. Reference character UM (M=1 to 12) denotes the possible range of a value obtained from the photo sensor 13 or 14 when each print medium is irradiated with ultraviolet light. The type of the print medium can be identified in detail depending on in which RN area the value (iR) obtained from the photo sensor when the print medium is irradiated with infrared light is present and in which UM area the value (uv) obtained from the photo sensors when the print medium is irradiated with ultraviolet light is present.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

This application claims priority from Japanese Patent Application Nos. 2004-107753 filed Mar. 31, 2004 and 2005-058088 filed Mar. 2, 2005, which are hereby incorporated by reference herein.

What is claimed is:

1. A print medium identifying device that identifies the type of a print medium used for a printing apparatus, the print medium identifying device comprising:

a light emitting section that irradiates a surface of the print medium with ultraviolet light and infrared light having a longer wavelength than the ultraviolet light;

a light receiving section that receives the light applied by the light emitting section and reflected by the surface of the print medium to output a signal corresponding to the quantity of light received; and identifying means for identifying the type of the print medium on the basis of a signal output by the light receiving section when the print medium is irradiated with the ultraviolet light and a signal output by the light receiving section when the print medium is irradiated with the infrared light, wherein the light emitting section is arranged such that an incident angle of the ultraviolet light is smaller than the incident angle of the infrared light, wherein the print medium identified by the identifying means includes ordinary paper, glossy paper, and matte paper, and wherein the identifying means identifies the print medium as glossy paper in the case where the signal output obtained from the reflected infrared light by the light receiving section is smaller than a second predetermined value when the print medium is irradiated with the infrared light, and identifies the print medium as matte paper in the case where the signal output obtained from the reflected infrared light by the light receiving section is larger than the second predetermined value when the print medium is irradiated with the infrared light and the signal output obtained from reflected ultraviolet light by the light receiving section is larger than a first predetermined value when the print medium is irradiated with the ultraviolet light, and identifies the print medium as ordinary paper in the case where the signal output obtained from reflected infrared light by the light receiving section is larger than the second predetermined value when the print medium is irradiated with the infrared light and the signal output obtained from the reflected ultraviolet light by the light receiving section is smaller than the first predetermined value when the print medium is irradiated with the ultraviolet light.

2. The print medium identifying device according to claim 1, wherein the first predetermined value is set on the basis of the content of a fluorescent agent contained in the print medium.

3. The print medium identifying device according to claim 1, wherein the second predetermined value is set on the basis of a gloss of the surface of the print medium.

4. The print medium identifying device according to claim 1, wherein the light receiving section has an optical filter that blocks a light beam in a particular wavelength range outside a wavelength range of light to be received.

5. The print medium identifying device according to claim 1, wherein the light receiving section has a light guiding member that directly receives part of light reflected by the surface of the print medium.

6. The print medium identifying device according to claim 5, wherein PMMA is used for a core material of the light guiding member, and plastic optical fiber comprising a fluorine-based resin is used for a clad material of the light guiding member.

7. A printing apparatus that forms an image by applying color materials to a print medium, the printing apparatus comprising:

the print medium identifying device according to claim 1; and control means for controlling predetermined operations related to a printing operation in accordance with the type of the print medium identified by the print medium identifying means.

8. A printing apparatus comprising:

printing means for applying color materials to a print medium;

conveying means for conveying the print medium:

the print medium identifying device according to claim 1; and control means for controlling the printing means and the conveying means in accordance with the type of the print medium identified by the print medium identifying means, wherein the printing apparatus performs a printing operation by using the conveying means to convey the print medium and using the printing means to apply the color materials to the print medium.

9. A print medium identifying method of identifying the type of a print medium used for a printing apparatus, the method comprising:

irradiating a surface of the print medium with ultraviolet light and infrared light having a longer wavelength than the ultraviolet light, both the ultraviolet light and the infrared light being emitted by a light emitting section, wherein the light emitting section is arranged such that an incident angle of the ultraviolet light is smaller than the incident angle of the infrared light;

receiving the light reflected by the surface of the print medium using a light receiving section that outputs a signal corresponding to the quantity of light received; and identifying the type of the print medium on the basis of a signal output by the light receiving section when the print medium is irradiated with the ultraviolet light and a signal output by the light receiving section when the print medium is irradiated with the infrared light, wherein the print medium identified by the identifying step includes ordinary paper, glossy paper, and matte paper, and wherein the identifying step identifies the print medium as glossy paper in the case where the signal output obtained from the reflected infrared light by the light receiving section is smaller than a second predetermined value when the print medium is irradiated with the infrared light, and identifies the print medium as matte paper in the case where the signal output obtained from the reflected infrared light by the light receiving section is larger than the second predetermined value when the print medium is irradiated with the infrared light and the signal output obtained from the reflected ultraviolet light by the light receiving section is larger than a first predetermined value when the print medium is irradiated with the ultraviolet light, and identifies the print medium as ordinary paper in the case where the signal output obtained from reflected infrared light by the light receiving section is larger than the second predetermined value when the print medium is irradiated with the infrared light and the signal output obtained from the reflected ultraviolet light by the light receiving section is smaller than the first predetermined value when the print medium is irradiated with the ultraviolet light.

* * * * *